United States Patent [19]

Clemens et al.

[11] 4,361,121

[45] Nov. 30, 1982

[54] CONTROL DEVICE FOR SHUTTING OFF A DIESEL ENGINE

[75] Inventors: Alexander Clemens, Stuttgart; Peter Schueler, Leonberg; Karl Reiff, Plochingen; Johann Warga, Möglingen, all of Fed. Rep. of Germany

[73] Assignee: Robert Bosch GmbH, Stuttgart, Fed. Rep. of Germany

[21] Appl. No.: 254,557

[22] Filed: Apr. 15, 1981

[30] Foreign Application Priority Data

Apr. 17, 1980 [DE] Fed. Rep. of Germany ..... 3014712

[51] Int. Cl.[3] ..... F02B 77/08; F02D 1/00

[52] U.S. Cl. ..... 123/198 DB; 123/198 D; 123/325; 123/332; 123/333

[58] Field of Search ..... 123/198 DB, 198 D, 325, 123/332, 333

[56] References Cited

U.S. PATENT DOCUMENTS 2,734,496 2/1956 Hammond ..... 123/198 DB 3,760,784 7/1973 Grondel et al. ..... 123/198 DB

*Primary Examiner*—Wendell E. Burns

*Attorney, Agent, or Firm*—Edwin E. Greigg

[57] ABSTRACT

A control device for Diesel engines is proposed in which a rapid shutoff of the engine can be effected by evacuating the suction chamber of the injection pump. The control device includes a supply pump and a reversal valve, which in a stop position connects the suction chamber with the intake side of the supply pump and connects the compression side of the supply pump with the fuel tank. A check valve is provided in the supply line between the supply pump and the fuel filter which, when closed, is vacuum-tight; this check valve is disposed to open toward the filter, counter to the force of a valve closing spring. Another check valve, comprising an overflow valve determining the suction chamber pressure, is provided in an overflow line leading from the suction chamber to the fuel tank; this overflow valve is also vacuum-tight when closed. When the reversal valve is actuated by an electromagnet, a similar key-actuated shutoff to that known in gasoline engines can also be effected in Diesel engines. The circuitry of this embodiment also enables an involuntary "rolling start" to be blocked, and allows for a fail-safe shutoff of the engine in case of a malfunction in the governor shutoff device.

4 Claims, 4 Drawing Figures

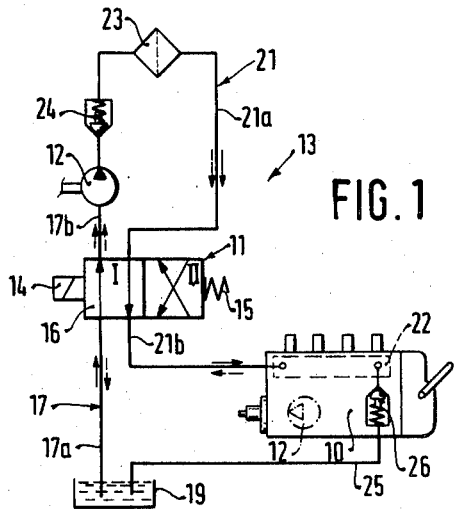
FIG. 1
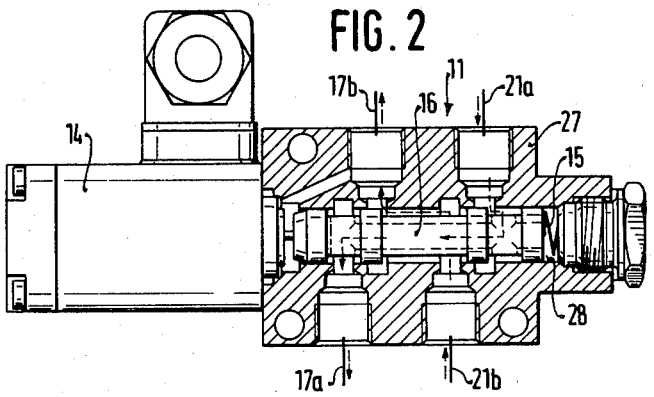
FIG. 2
FIG. 3
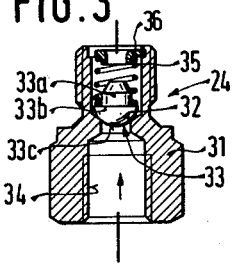
FIG. 4
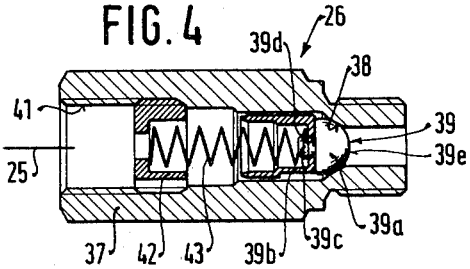

CONTROL DEVICE FOR SHUTTING OFF A DIESEL ENGINE

BACKGROUND OF THE INVENTION

The invention is an improvement upon a control device for shutting off a Diesel engine having a reversal valve, a valve which has both supply and shutoff states. A control device of this kind is already known from German Pat. No. 941,236. In the known shutoff device, in order to shut off the engine the supply pump can be reversed by means of a reversal valve, so that the suction chamber of the injection pump is made to communicate with the intake side of the supply pump, while the compression side of the supply pump is made to communicate with the tank. During such reversal, fuel is abruptly withdrawn from the suction chamber of the injection pump, so that the injection pump can no longer supply fuel, and the engine associated with it shuts down. In this known control device the suction action of the known supply pump generates insufficient vacuum in the suction chamber of the injection pump to effect shutoff; thus, the section action of the injection pump itself, because of the extremely precisely manufactured pump elements, is greater than that of the supply pump. Accordingly, even through the reversal valve assumes a "stop" position, the injection pump can continue to aspirate fuel, counter to the intake direction of the supply pump, at least out of the fuel filter but also through the closed valves of the supply pump. When a geared pump is used, as is the case in the patent cited above, the gear-train sealing provided at the gears, which simultaneously act as valves, is not so great that they are impervious to a vacuum. Alternatively, it is flat seat valves which are most frequently used in supply pumps mounted on Diesel injection pumps; and flat seat valves do not attain the sealing and suction effect which is required for shutting off the engine.

OBJECT AND SUMMARY OF THE INVENTION

A principal object of the control device in accordance with the invention is to attain a very satisfactory shutoff of the Diesel engine. To achieve this object, the invention provides for two check valves which seal tightly with respect to vacuum leaks. A surprising improvement in the functioning of the control device occurs, so much so that sufficient fuel is withdrawn from the suction chamber within a very short period of time, even under unfavorable operational states of the engine, and the engine shuts off virtually immediately.

Another object of the invention provides that the supply output of the supply pump, and in particular the suction output required for shutting off the engine, is improved to the extent that the fuel injection pump is prevented from further operation, that is, from further aspiration of so much fuel that the engine would continue to operate, although with hesitation, in spite of the reversed supply direction of the supply pump.

A further object of the invention provides that the required reservoir effect of the overflow valve is retained.

A still further object of the invention is that the sealing effect of the valve closing element is substantially improved.

Yet another object of the invention is that assembly of the two main operating parts can be done in the simplest manner, without complex tools and additional aids, by being snapped into place.

The invention will be better understood and further objects and advantages thereof will become more apparent from the ensuing detailed description of a preferred embodiment taken in conjunction with the drawing.

BRIEF DESCRIPTION OF THE DRAWING

FIG. 1 is a schematic illustration of the control device according to the invention, wherein the elements are represented by standardized circuit symbols;

FIG. 2 shows a cross section through an exemplary embodiment of the reversal valve used in FIG. 1;

FIG. 3 shows an enlarged illustration of a check valve according to the invention, sealed against vacuum, inserted downstream of the supply pump; and FIG. 4 shows a cross section taken through the overflow valve, revealing modifications in accordance with the invention.

DESCRIPTION OF THE PREFERRED EMBODIMENT

The preferred embodiment shown schematically in FIG. 1 includes a control device 13 provided in the fuel supply system of an injection pump 10, which has a reversal valve 11 and a supply pump 12. The structural details of the reversal valve 11 are shown in FIG. 2, and will be discussed hereinafter.

In FIG. 1, a valve means 16 of the reversal valve 11 has been displaced counter to the force of an actuating spring 15 by an electromagnet 14 furnished with operating current and is in a first operating position (indicated as I). In this position, the reversal valve 11, which comprises a 4/2-way valve, connects two sections 17*a* and 17*b* of an intake line 17, and thereby connects an intake side S of the supply pump 12 with a fuel tank 19. In addition, the valve means 16 also connects two sections 21*a* and 21*b* of a supply line 21 and thereby connects an exhaust side D of the supply pump 12 with a suction chamber 22, indicated by broken lines, of the injection pump 10. A fuel filter 23 is inserted into the first line section 21*a*, and a check valve 24, which is vacuum-sealed, is inserted between the filter 23 and the supply pump 12. The functioning and structure of this check valve 24 will be described below, in connection with FIG. 3.

The supply pump 12, which is preferably driven mechanically, is a piston supply pump of know type equipped with an intake valve and a pressure valve. As indicated by dot-dash lines in FIG. 1, this pump 12 is mounted on the injection pump 10 at the level of the camshaft as a general rule. The check valve 24 must be vacuum-sealed; such a seal is also a requirement in the closed state for an overflow valve 26, provided in an overflow line 25 exiting from the suction chamber 22, or the shutoff device will not function properly.

FIG. 2 shows a preferred embodiment of the reversal valve 11 of FIG. 1. The lines 17*a*, 17*b*, 21*a*, and 21*b* of the control device 13, which are connected to the valve 11, are indicated only symbolically in FIG. 2. The valve means 16 of the reversal valve 11 comprises a valve slide formed as a piston, and actuated by the electromagnet 14 counter to the force of the restoring spring 15. This valve means 16 is longitudinally displaceable within a valve guide bore 28 provided in a valve housing 27. Control channels are provided in the valve housing 27 for reception of the line sections 17*a*, 17*b*, 21*a* and 21*b* and for communication with the valve guide bore 28. These channels, not shown in great detail, are machined into the valve housing 27 at right angles to the longitudinal axis of the valve guide bore 28 and planar thereto.

The valve means 16 of the reversal valve 11 is shown in FIG. 2 in a "stop" position, indicated by II in FIG. 1. The valve means 16 assumes this position, in response to the force of an actuating spring 15, whenever the electromagnet 14 has no current running through it. In the stop position, the flow of fuel proceeds from the suction chamber 22, through the line section 21*b*, into the valve guide bore 28 of the reversal valve 11, and to the line section 17*b* of the intake line 17. The fuel flow is subject to the intake pressure of the supply pump 12, which then delivers the fuel withdrawn from the suction chamber 22 back to the tank 19 by way of the line section 21*a*, the corresponding control channels in the reversal valve 11, and the line section 17*a*. The overflow valve 26 provided at the outlet of the suction chamber 22 is sealed tightly with respect to vacuum to prevent the reaspiration, via the overflow line 25, of the fuel delivered back to the tank 19.

The fuel flow described above is indicated by arrows in the drawings at or within the respective line sections. In FIG. 1, in which the reversal valve 11 is shown in its operating position I, the fuel feed associated with that position is indicated by solid-line arrows. The broken-line arrows beside the line sections 21*a*, 21*b* and 17*a*, 17*b* indicate the reversed flow direction of the stop position already described in connection with FIG. 2; this reversed flow direction in lines 21*a*, 21*b* and 17*a*, 17*b* is indicated by broken lines in FIG. 2 as well. This reversed flow direction occurs whenever the pump supply of the injection pump 10 is interrupted by means of the partial evacuation of the suction chamber 22 in order to shut off the engine.

In the stop position of the valve slide 16 shown in FIG. 2, which corresponds with engine shutoff, the suction chamber 22 is subject not only to the suction action of the supply pump 12 but also to the suction action of the pumping elements of the injection pump 10. In order that this relatively great suction vacuum will not cause fuel to aspirate back out of the filter 23 or the tank 19 through the supply pump 12, counter to the supply direction of the supply pump 12, a supplementary check valve 24 has been provided in the line section 21*a* between the supply pump 12 and the filter 23. One possible embodiment for a check valve 24 of this kind, threaded onto the outlet nozzle of the supply pump 12, is shown in FIG. 3.

Referring to FIG. 3, there is shown a valve housing 31 provided with a check valve 24 which is sealed against vacuum. The check valve 24 includes a conical valve seat 32, which is sealed by a mushroom-shaped valve closing means 33 whenever there is no flow of fuel (in the direction of the arrow shown) into a bore 34 provided in the valve housing 31. The valve closing member 33 is made of soft, elastic material, preferably of fuel-resistant plastic, such as a fluoroelastomer. The valve closing means is urged in the closing direction toward the valve seat 32 by a valve closing spring 35 comprising a helical spring. The helical spring 35 is supported at one extremity on a first spring support 33*d* comprising a mandrel 33*a*, and supported at the other extremity on a second spring support 36 simultaneously serving as the stop plate for the mandrel 33*a* on the valve closing means 33. A hemispherical face 33*c* is provided on the closing element 22*b* of the closing means 33 to cooperate with the valve seat 32 for positive closure, yet the face 33*c* is streamlined so as not to impede fuel flow when open. In combination with the selected pairing of manufacturing materials, the hemispherical face 33*c* assures that a tightness of sealing, which is required against the vacuum prevailing during shutoff of the engine, will be attained.

The overflow valve 26 of FIG. 1, the details of which are shown in cross section in FIG. 4, includes a valve housing 37 similar to that of the check valve 24 of FIG. 3 in that the valve housing 37 is provided with a conical valve seat 38, and with a valve closing means 39 comprising mushroom-shaped closing element 39*a* manufactured of a soft, elastic material, preferably a fuel-resistant plastic such as a fluoroelastomer. The valve closing means 39 differs in that a cylindrical reservoir piston 39*b* made of metal is provided on one end opposite from an end provided with a streamlined, hemispherical closing face 39*e*. A tang 39*c* is provided on the one end of the closing element 39*a*. This tang 39*c* is associated with a central bore 39*d* provided in the bottom of the cup-like reservoir piston 39*b* and is secured in the manner of a snap-fit. This connection can be effected in a simple manner without additional tools or external aids and satisfying the demands placed upon it, makes it possible to select different manufacturing materials for the two parts of the valve closing member 39, which is to be preferred based on their disparate function. A spring retainer 42, comprising a threaded element screwed into a threaded bore 41, is provided for a helical spring 43, serving as a restoring spring. The spring retainer 42 is threaded into the bore 41 to such a recessed depth that the outermost portion of bore 41 can be connected to the overflow line 25, here shown only symbolically.

Although the function of the safety device according to the invention can already be inferred from the above description, it will be explained in context hereinafter.

In the operating position I of the reversal valve 11 indicated in FIG. 1 for the valve means 16, the supply pump 12 draws fuel out of the tank 19 via the intake line section 17*a*, through the reversal valve 11 and the intake line section 17*b*, and feeds it via the check valve 24 and the filter 33 through the supply line section 21*a*, back through the reversal valve 11 to the supply line section 21*b*, and into the suction chamber 22 of the injection pump 10. Excess fuel, not needed to be delivered to the nozzles, flows out of the suction chamber 22 and back to the tank 19 via the overflow valve 26 and the overflow channel 25.

In order to shut off the engine, the electromagnet 14 is turned off causing the valve means 16 to be displaced by the actuating spring 15, into the stop position (as shown in FIG. 2 and as indicated by II in FIG. 1). In this stop position II of the valve means 16, the intake line section 17*b* communicating with the intake side S of the supply pump is connected via the reversal valve 11 with the line section 21*b*, and thereby with the suction chamber 22; at the same time, the supply line section 21*a* is connected via the reversal valve 11 with the intake line section 17*a*. Fuel is thereby withdrawn from the suction chamber 22 by the supply pump 12 and delivered back to the tank 19.

Whenever the electromagnet 14 lacks electric current and triggers the movement of the valve member 16 into the stop position II, as described in connection with FIGS. 1 and 2 above, then the key-actuated shutoff which is available in gasoline engines can also be effected in Diesel engines, by connecting the supply of current leading to the electromagnet 14 to an "ignitiion lock". The same circuitry also provides a "rolling start block", which is intended to prevent the Diesel engine from turning over automatically and starting when the ignition key has been removed; such phenomena could occur when the car "runs away" parked on a hill. By means of an additional switch, which may be actuated by a control member linked to the engine brake, an automatic fuel shutoff during engine braking is also possible. Alternatively, the control device 13 described herein may be put into action only for emergency or safety shutoff purposes, as a "fail-safe" back-up system should the principal shutoff device engaging the governor or acting upon the governor rod of the injection pump malfunction or otherwise not be actuated for some reason.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A control device for shutting off a Diesel engine, including a fuel tank, an intake line having first and second inlet sections, each of said inlet sections having end portions, a reversal valve, said first inlet section being connected between the fuel tank and the reversal valve, a supply pump having an intake side and an exhaust side connecting one end of said second inlet section to said reversal valve, a supply line having first and second supply sections, a fuel filter provided in the first supply section, each of said supply sections having end portions, one end portion of said first supply section connecting said supply pump to said reversal valve, an injection pump having a suction chamber associated with said engine, one end portion of said second supply section connecting said reversal valve to said suction chamber, an overflow line connecting said suction chamber to said fuel tank, said reversal valve having a stop position and an operational position, whereby in said stop position the suction chamber is conected to the intake side of said supply pump and the exhaust side of the supply pump is connected to said fuel tank, the improvement comprising first check valve means provided in said first supply section between the exhaust side of said supply pump and said fuel filter, said first check valve means having spring means to seal against vacuum, when fuel ceases to flow, and second check valve means provided in said overflow line between said suction chamber and said fuel tank, said second check valve means is arranged to seal against vacuum when closed, and further wherein said second check valve means is arranged to determine pressure in said suction chamber.

2. A control device as defined by claim 1, the improvement further comprising that said first check valve means and said second check valve means are each provided with a valve member having an elastic valve closing element associated therewith, said elastic valve closing element provided with a streamlined, hemispherical face.

3. A control device as defined by claim 2, the improvement further comprising that said first check valve means is provided with a mandrel arranged as a first spring support, with a second spring support and with a spring disposed therebetween, whereby when fully opened said mandrel can abut said second spring support.

4. A control device as defined by claim 2, the improvement further comprising that said second check valve means includes a metallic cup-like reservoir piston provided with a central bore, and said valve member is provided with a tang having an end portion, said end portion being of larger diameter than said tang, whereby said valve member may be pushed into said bore in a positive, snap-fitted engagement.

* * * * *